US008370983B2

(12) United States Patent
Tokuno et al.

(10) Patent No.: US 8,370,983 B2
(45) Date of Patent: Feb. 12, 2013

(54) RIGID CONNECTION STRUCTURE OF BRIDGE PIER AND CONCRETE GIRDER

(75) Inventors: Mitsuhiro Tokuno, Ishikawa (JP); Fumihiro Saito, Ishikawa (JP)

(73) Assignees: Asahi Engineering Co., Ltd., Ishikawa (JP); Eco Japan Co., Ltd., Ishikawa (JP)

( * ) Notice: Subject to any disclaimer, the term of this patent is extended or adjusted under 35 U.S.C. 154(b) by 49 days.

(21) Appl. No.: 13/122,741

(22) PCT Filed: Oct. 21, 2009

(86) PCT No.: PCT/JP2009/005505

§ 371 (c)(1),
(2), (4) Date: Apr. 6, 2011

(87) PCT Pub. No.: WO2010/047096

PCT Pub. Date: Apr. 29, 2010

(65) Prior Publication Data

US 2011/0191967 A1 Aug. 11, 2011

(30) Foreign Application Priority Data

Oct. 24, 2008 (JP) ..... 2008-274493

(51) Int. Cl.
*E01D 19/02* (2006.01)
*E01D 1/00* (2006.01)

(52) U.S. Cl. ..... 14/74.5; 14/75; 14/77.3; 52/283; 52/837

(58) Field of Classification Search ..... 14/74.5, 14/75, 77.3; 52/251, 252, 259, 262, 272, 52/283, 600, 649.2, 837
See application file for complete search history.

(56) References Cited

U.S. PATENT DOCUMENTS

| | | | | | |
|---|---|---|---|---|---|
| 910,947 | A | * | 1/1909 | Needs | 52/600 |
| 1,538,218 | A | * | 5/1925 | Eggleston | 52/704 |
| 3,303,627 | A | * | 2/1967 | Mora | 52/649.2 |
| 3,513,610 | A | * | 5/1970 | Devonport | 52/283 |
| 3,590,547 | A | * | 7/1971 | Molyneux et al. | 52/834 |
| 4,977,636 | A | * | 12/1990 | King | 14/73 |

(Continued)

FOREIGN PATENT DOCUMENTS

JP 401203540 * 8/1989

(Continued)

OTHER PUBLICATIONS

International Search Report issued Nov. 17, 2009 in International (PCT) Application No. PCT/JP2009/005505.

*Primary Examiner* — Raymond W Addie
(74) *Attorney, Agent, or Firm* — Wenderoth, Lind & Ponack, LLP.

(57) ABSTRACT

In a rigid connection structure of a bridge pier and concrete girder, a joint-equipped PC concrete girder is constituted by burying a rear half part of a shaped-steel joint formed of short shaped-steel respectively in both ends of the concrete girder and protruding a front half part of each shaped-steel joint respectively from each end face of the concrete girder, the respective shaped-steel joint portions protruded from the respective end faces of the concrete girders are supported on a bridge abutment face of a bridge pier while being connected to a connection strip member which arises from the bridge abutment face, and the respective shaped-steel joint portions and the connection strip member are buried in connection concrete which is additionally casted on the bridge abutment face.

22 Claims, 25 Drawing Sheets

U.S. PATENT DOCUMENTS

| | | | | |
|---|---|---|---|---|
| 5,311,629 | A * | 5/1994 | Smith | 14/73.1 |
| 5,342,138 | A * | 8/1994 | Saito et al. | 403/189 |
| 5,771,518 | A * | 6/1998 | Roberts | 14/73.1 |
| 5,867,855 | A * | 2/1999 | Kim | 14/77.1 |
| 6,739,099 | B2 * | 5/2004 | Takeuchi et al. | 52/167.1 |
| 8,166,717 | B2 * | 5/2012 | Kim | 52/326 |
| 2007/0251031 | A1 | 11/2007 | Tokuno et al. | |

FOREIGN PATENT DOCUMENTS

| | | | |
|---|---|---|---|
| JP | 407018734 | A * | 1/1995 |
| JP | 2002-4224 | | 1/2002 |
| JP | 2007-211566 | | 8/2007 |
| WO | 2001/096665 | | 12/2001 |

* cited by examiner

RIGID CONNECTION STRUCTURE OF BRIDGE PIER AND CONCRETE GIRDER

BACKGROUND OF THE INVENTION

1. Technical Field

The present invention relates to a rigid connection structure of each end of a concrete girder and a bridge pier of a rigid-frame bridge.

2. Background Art

Japanese Patent Application Laid-Open 2007-211566 discloses a rigid-frame bridge in which a concrete bridge pier and each end of a steel girder are rigidly connected via connection by a connection strip member and connection concrete. Here, the steel girders formed of shaped-steel such as H-shaped steel are arranged in parallel in the bridge width direction and each end of the steel girder is supported on a bridge abutment face of a concrete bridge pier. Further, each end of each steel girder is connected to a connection strip member arising from a bridge abutment face of the bridge pier, and then, each end of the steel girder is buried in the connection concrete by additionally casting the connection concrete on the bridge abutment face.

Bridge construction using steel girders constituted with shaped-steel such as H-shaped steel which causes overspending of steel material has been restricted for actualization in view of profitability as a result of recent escalating prices of steel material.

Further, shape selection of shaped-steel corresponding to an individual bridge is difficult because of difficulty of shape changing thereof.

In contrast, a precast concrete girder (PC concrete girder) is extremely inexpensive compared to a steel girder and is capable of being formed in arbitrary shaped easily in accordance with bridge design.

SUMMARY OF THE INVENTION

The present invention provides a rigid connection structure of a bridge pier and a concrete girder capable of providing robust rigid connection of each end of the concrete girder and the bridge pier while utilizing the concrete girder as a bridge girder.

In the present invention, a joint-equipped precast concrete girder (a joint-equipped PC concrete girder) constituted by burying a rear half part of a shaped-steel joint formed of short shaped-steel respectively in both ends of a concrete girder and being protruded a front half part of each shaped-steel joint from each end face of the concrete girder is previously prepared.

Here, the front half part and the rear half part are not limited to respectively have half length, as including a case that one is long and the other is short.

The joint-equipped PC concrete girders are carried to a construction site. Shaped-steel joint portions protruded from the respective concrete girder are supported on a bridge abutment face of a bridge pier while arranging the joint-equipped PC concrete girders in parallel in the bridge width direction.

Then, the rigid connection structure of the bridge pier and the concrete girders is formed by connecting the respective shaped-steel joint portions protruded from the respective end faces of the concrete girders to each connection strip member arising from the bridge abutment face of the bridge pier and burying the respective shaped-steel joint portions and the connection strip members in connection concrete which is additionally cased on the bridge abutment face.

The connection strip member is inserted through a flange of each shaped-steel joint portion and a nut is fixed on the flange as being screwed to an insertion end of the connection strip member. The nut is also buried in the connection concrete.

Instead of connecting with a nut, the shaped-steel joint portion and the connection strip member may be connected by welding or utilizing a connection clasp such as a wedge. The nut, welding and the connection clasp have a stopper function to prevent separation of the shaped-steel joint portion from the connection strip member.

A lateral connecting strip member is inserted through the respective shaped-steel joint portions protruded from the concrete girders and the shaped-steel joint portions of the adjacent concrete girders are mutually connected via the lateral connecting strip member. The lateral connecting strip member is buried in the connection concrete as well.

As described above, the concrete girder and the connection concrete are integrally structured via the shaped-steel joint by burying a rear half part of the shaped-steel joint in concrete at an end portion of the concrete girder and burying a front half part of the shaped-steel joint in the connection concrete.

The present invention includes an embodiment to indirectly receive the concrete girder as the respective shaped-steel joint portions protruded from end faces of the concrete girders being received on the bridge abutment face of the bridge pier and an embodiment to directly receive each end of the concrete girders on the bridge abutment surface as the respective shaped-steel joint portions being received on the bridge abutment face of the bridge pier.

According to the present invention, bridging cost can be drastically reduced compared to a rigid-frame bridge using the above steel girders and total quantity of steel material can be reduced. Further, concrete girders can be flexibly formed into a shape in accordance with a bridging site without shape restriction for steel girders.

In addition, concrete quantity for casting to a space between girders at the site can be reduced and casting operation can be lightened.

DETAILED DESCRIPTION OF THE INVENTION

Figure 1:
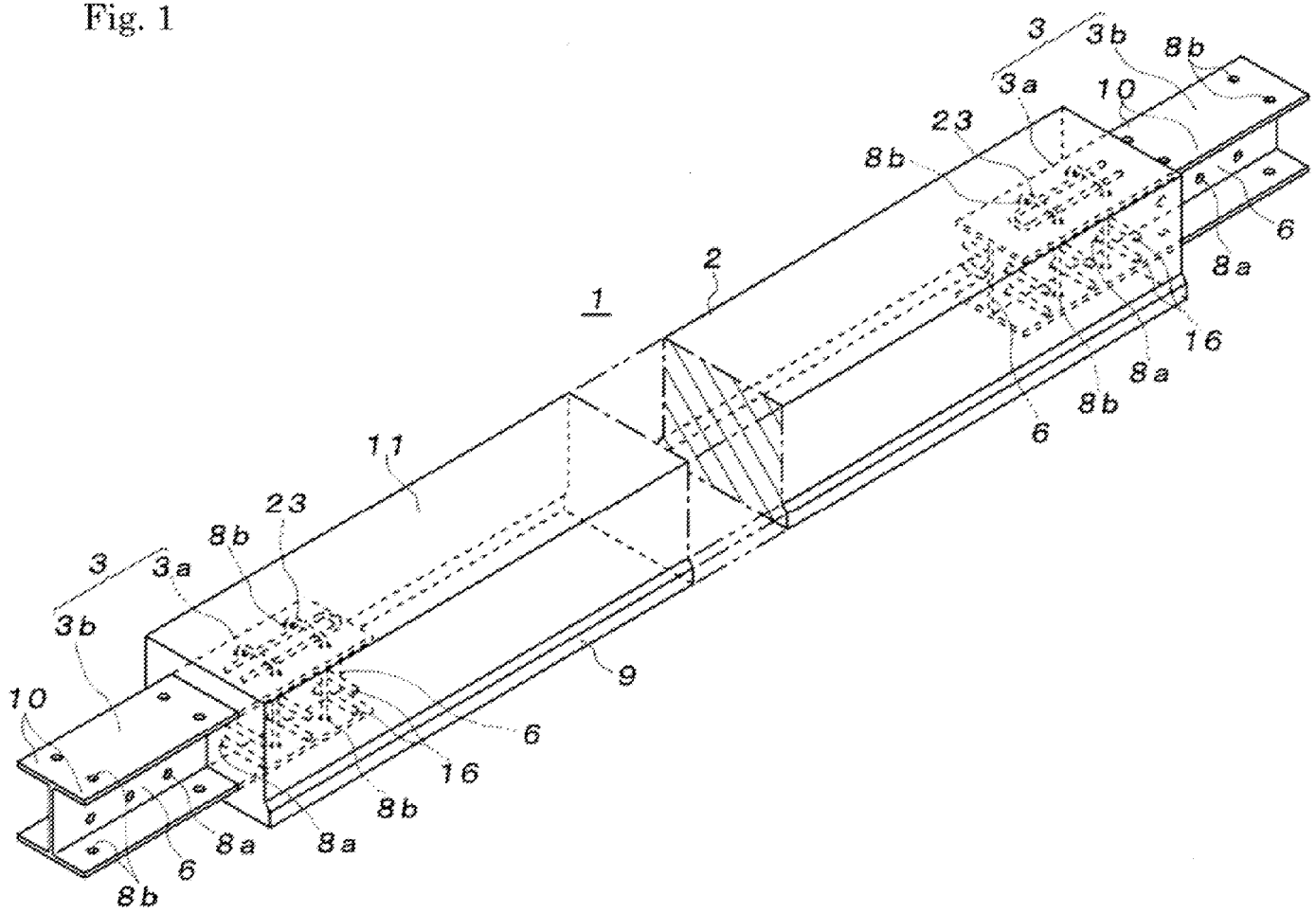
FIG. 1 is a perspective view illustrating a first embodiment of a joint-equipped PC concrete girder utilized for a rigid connection structure of a concrete bridge pier (including a bridge abutment) and a concrete girder according to the present invention.
Figure 2:
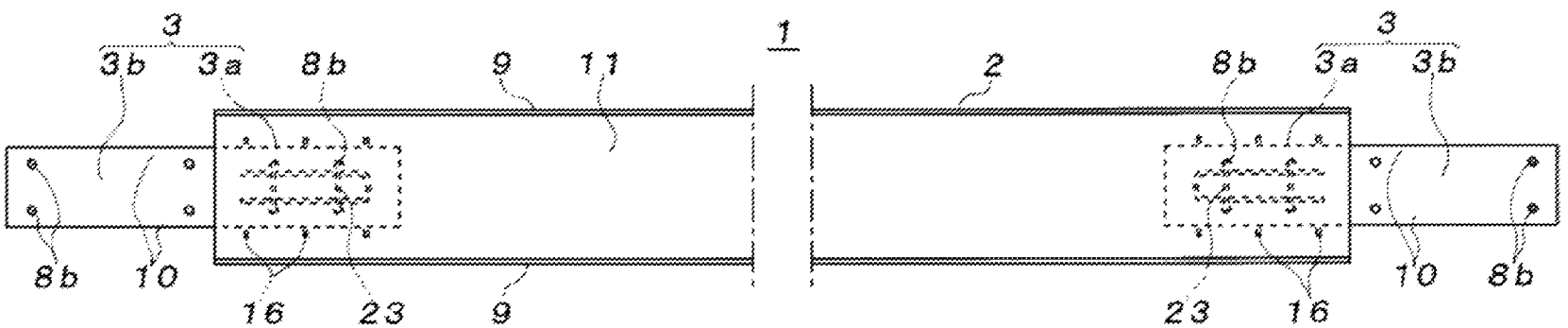
FIG. 2 is a plan view of the concrete girder in FIG. 1.
Figure 3:
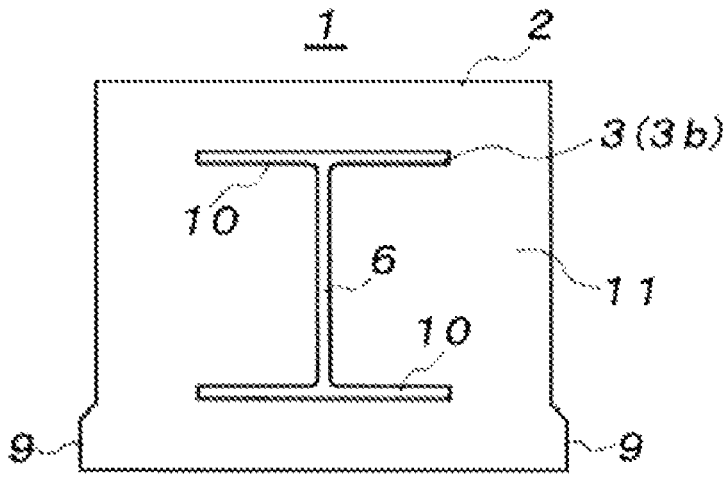
FIG. 3 is a front view of the concrete girder in FIG. 1.
Figure 4:
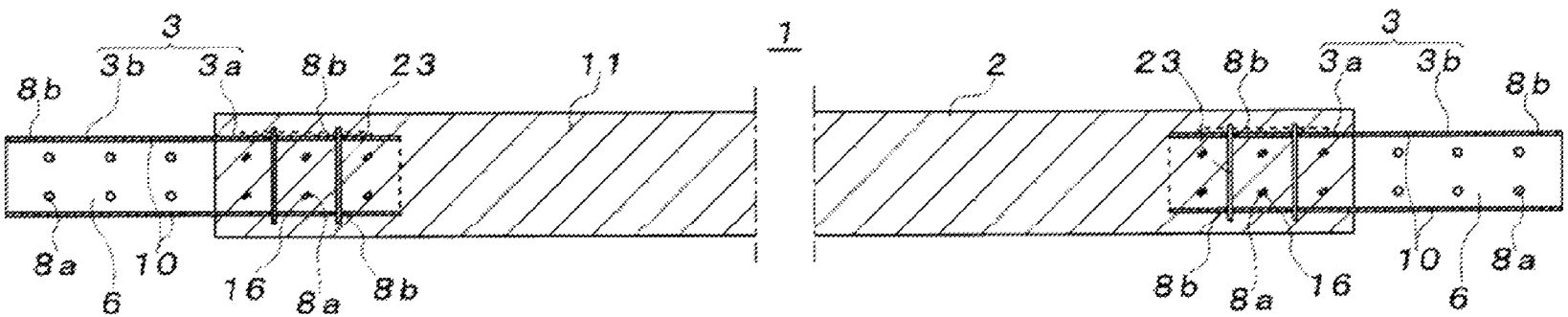
FIG. 4 is a longitudinal sectional view of the concrete girder in FIG. 1.

In the following, preferable embodiments will be described with reference to FIGS. 1 to 25.

FIGS. 1 to 5 illustrate a first embodiment of a joint-equipped PC concrete girder 1 utilized for a rigid connection structure of a concrete bridge pier 4 (including a bridge abutment) and a concrete girder 2 according to the present invention. FIGS. 6 to 10 illustrate a second embodiment of the joint-equipped PC concrete girder 1 and FIGS. 11 to 16 illustrate a third embodiment of the joint-equipped PC concrete girder 1.

The joint-equipped PC concrete girder 1 of each embodiment is provided with a pair of shaped-steel joints 3 formed of short shaped-steel at respective ends of the concrete girder 2.

The joint-equipped PC concrete girder 1 is formed as a rear half part of each shaped-steel joint 3 formed of the short shaped-steel being buried in each end portion of the concrete girder 2 and a front half part of each shaped-steel joint 3 being protruded from each end face of the concrete girder 2.

Specifically, a shaped-steel joint portion 3*a* being a rear half part of the first shaped-steel joint 3 is buried in the concrete girder 2 at one end thereof. A shaped-steel joint portion 3*b* being a front half part of the first shaped-steel joint 3 is protruded from a face of the one end of the concrete girder 2.

Similarly, a shaped-steel joint portion 3*a* being a rear half part of a second shaped-steel joint 3 is buried in the concrete girder 2 at the other end thereof. A shaped-steel joint portion 3*b* being a front half part of the second shaped-steel joint 3 is protruded from a face of the other end of the concrete girder 2.

Here, the front half part and the rear half part in the above are not intended to denote respective parts having half length of the shaped-steel joint 3, but rather includes a case that one is long and the other is short.

Plural through holes 8*a* penetrating a web 6 in the bridge width direction are arranged at the shaped-steel joint portion 3*b* protruded from the end face of the concrete girder 2. The through holes 8*a* are used for insertion of lateral connecting strip members 7 which are described later.

Further, plural through holes 8*b* penetrating a flange 10 of the shaped-steel joint portion 3*b* in the vertical direction are arranged. The through holes 8*b* are used for insertion of connection strip members 13 which are described later.

Meanwhile, plural through holes 8*a* penetrating the web 6 in the bridge width direction are arranged at the shaped-steel part 3*a* which is buried in the end portion of the concrete girder 2. Reinforcing rebars 16 are inserted in the through holes 8*a* and the reinforcing rebars 16 are buried in the concrete girder 2.

The reinforcing rebars 16 may be buried in the concrete girder 2 as short straight rebars being inserted respectively through the through holes 8*a* or a rebar longer than the above being bent in the longitudinal direction of the concrete girder 2 while being inserted through the respective through holes 8*a*.

In the first embodiment illustrated in FIGS. 1 to 5, an approximate inverted T-shaped concrete girder 2 having small width flanges 9 at both lower sides of a pillar-shaped portion 11 having a relatively large sectional area is utilized for the concrete girder 2. Further, H-shaped steel having flanges 10 at both sides of upper and lower ends of the web 6 is utilized for the shaped-steel joint 3, with the rear half part of the H-shaped (aka, I-shaped) steel 3 being buried in an end portion of the concrete girder 2 and the front half part of the H-shaped steel 3 being protruded from the end face of the concrete girder 2. Then, both the girder and the joint 2, 3 are structured integrally as described above.

The through holes 8*b* are arranged at the upper and lower flanges 10 in the case that the shaped-steel joint 3 is formed of H-shaped steel.

Figure 5:
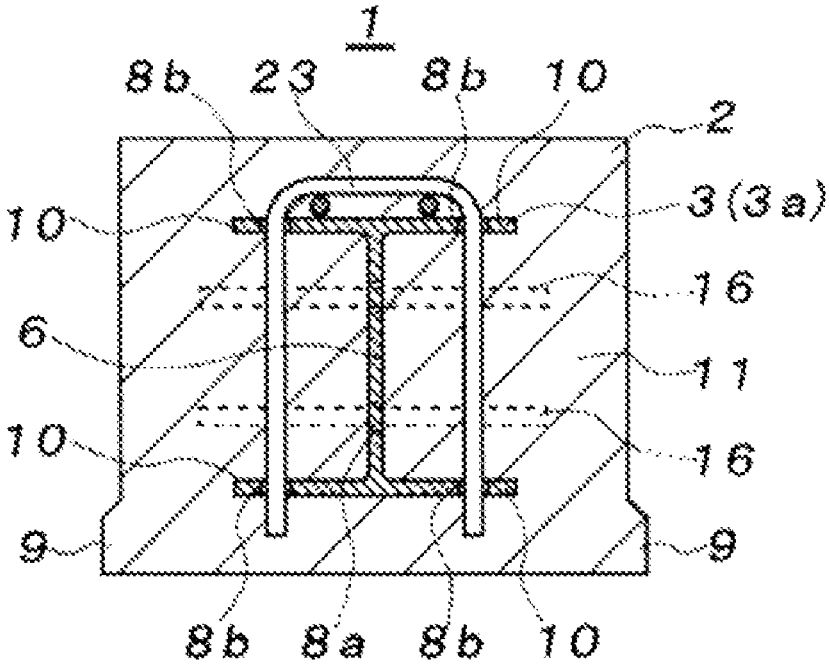
FIG. 5 is a transverse sectional view of the concrete girder in FIG. 1.
Figure 6:
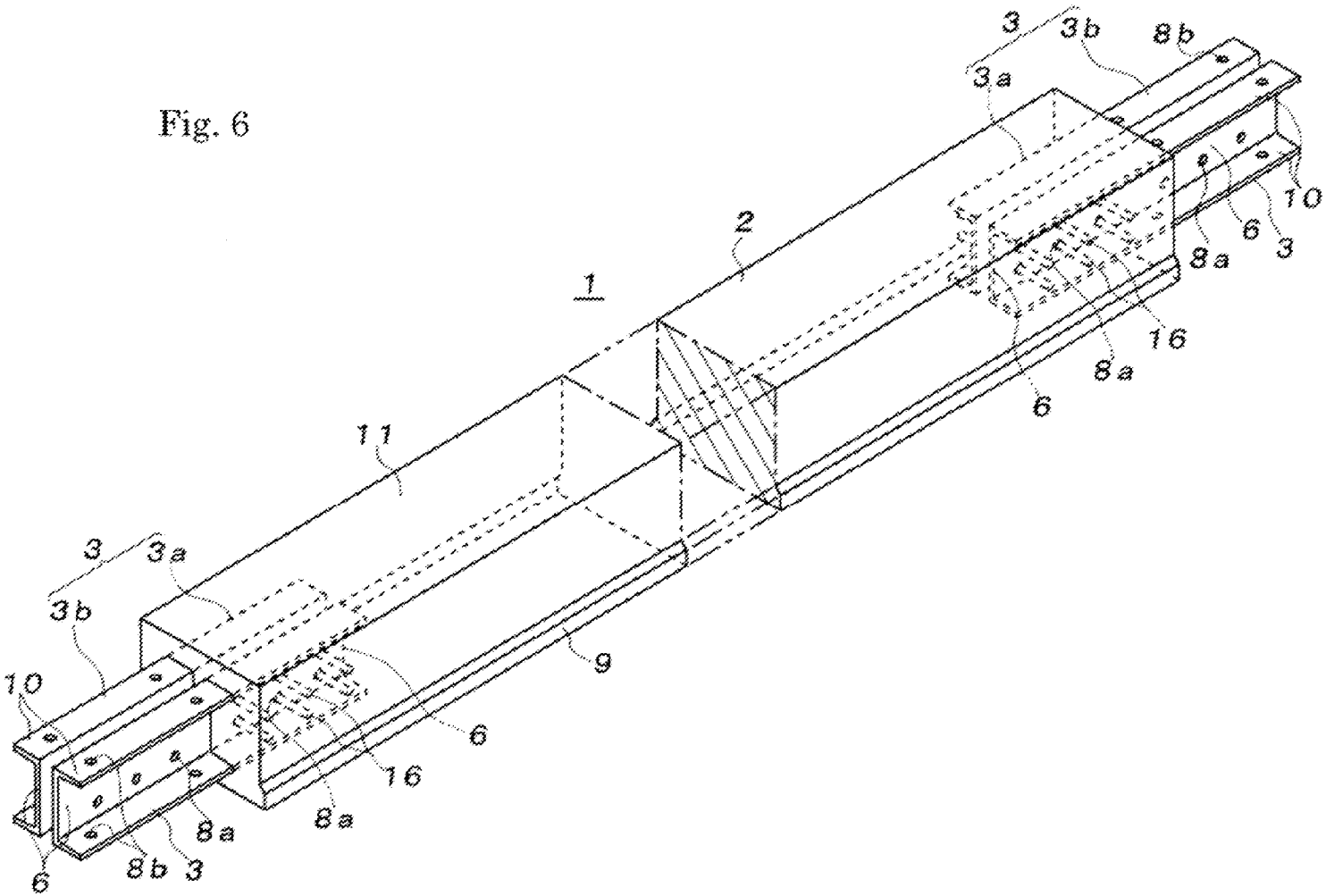
FIG. 6 is a perspective view illustrating a second embodiment of a joint-equipped PC concrete girder utilized for a rigid connection structure of a concrete bridge pier (including a bridge abutment) and a concrete girder according to the present invention.
Figure 7:
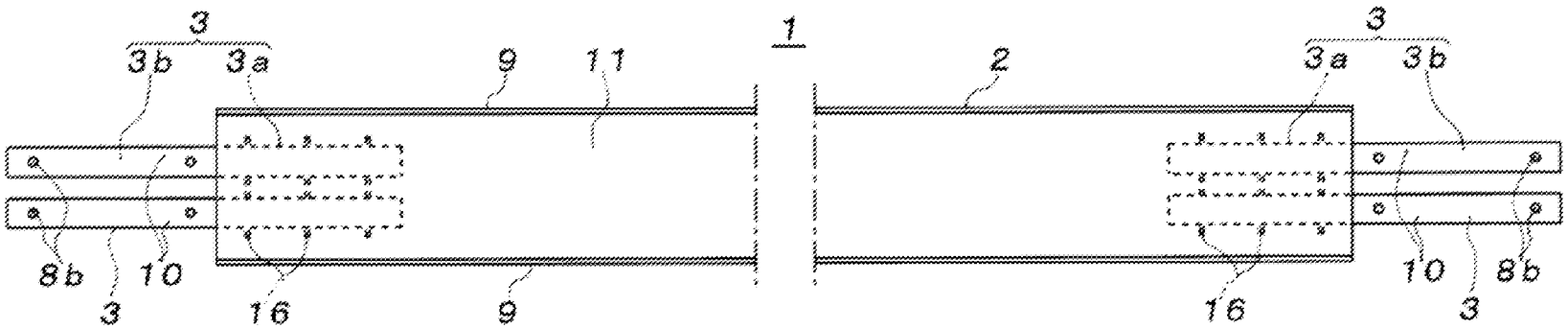
FIG. 7 is a plan view of the concrete girder in FIG. 6.
Figure 8:
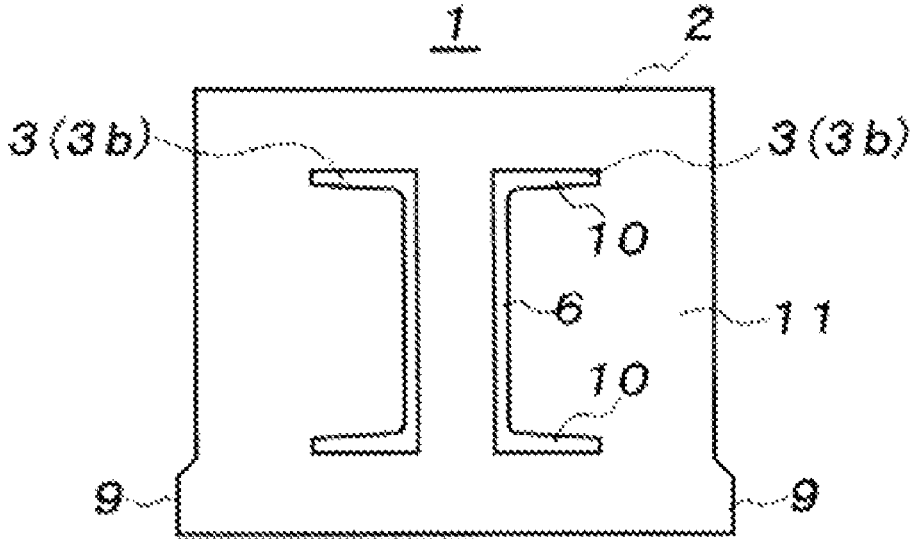
FIG. 8 is a front view of the concrete girder in FIG. 6.
Figure 9:
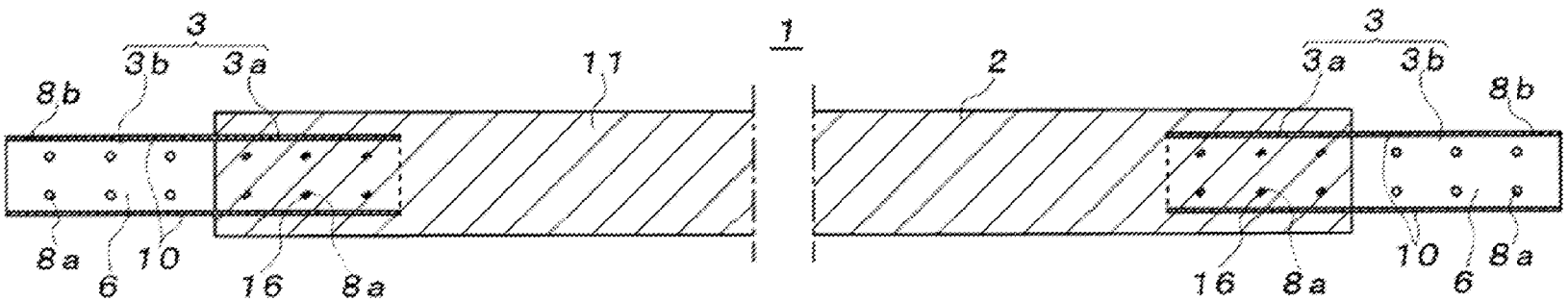
FIG. 9 is a longitudinal sectional view of the concrete girder in FIG. 6.
Figure 10:
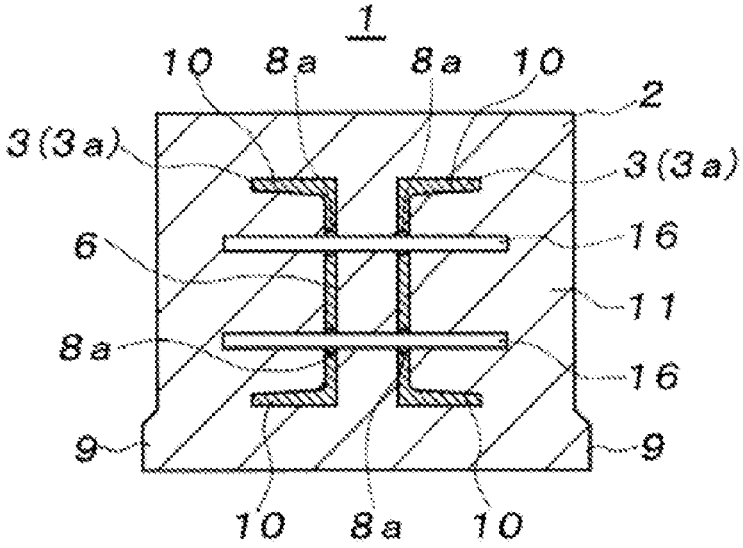
FIG. 10 is a transverse sectional view of the concrete girder in FIG. 6.
Figure 11:
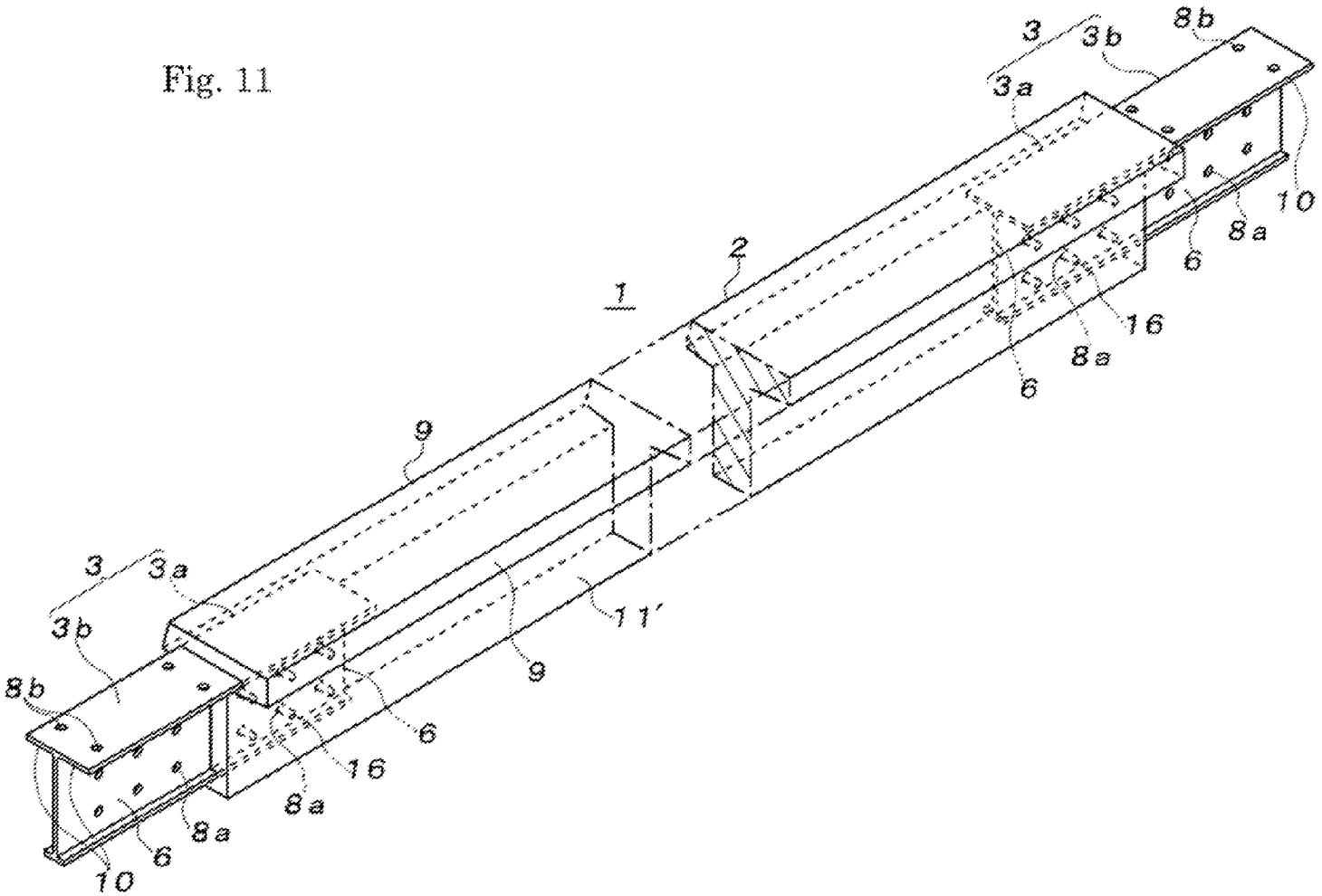
FIG. 11 is a perspective view illustrating a third embodiment of a joint-equipped PC concrete girder utilized for a rigid connection structure of a concrete bridge pier (including a bridge abutment) and a concrete girder according to the present invention.
Figure 12:
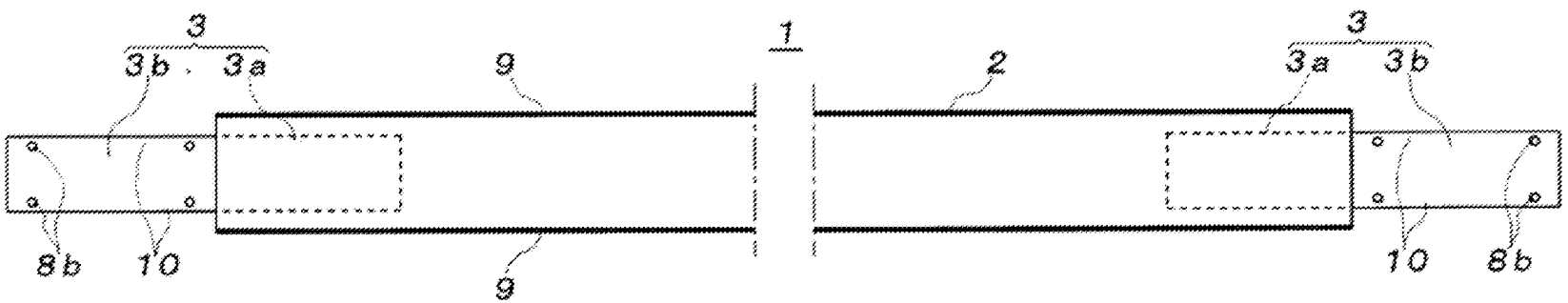
FIG. 12 is a plan view of the concrete girder in FIG. 11.
Figure 13:
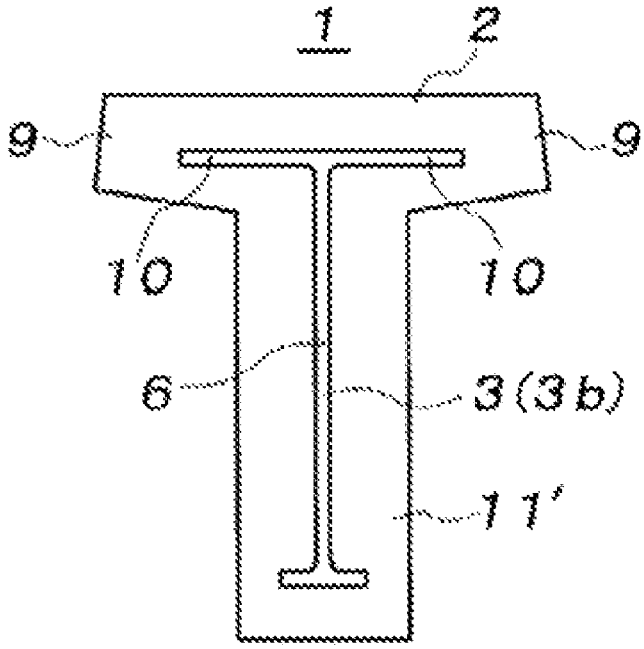
FIG. 13 is a front view of the concrete girder in FIG. 11.
Figure 14:
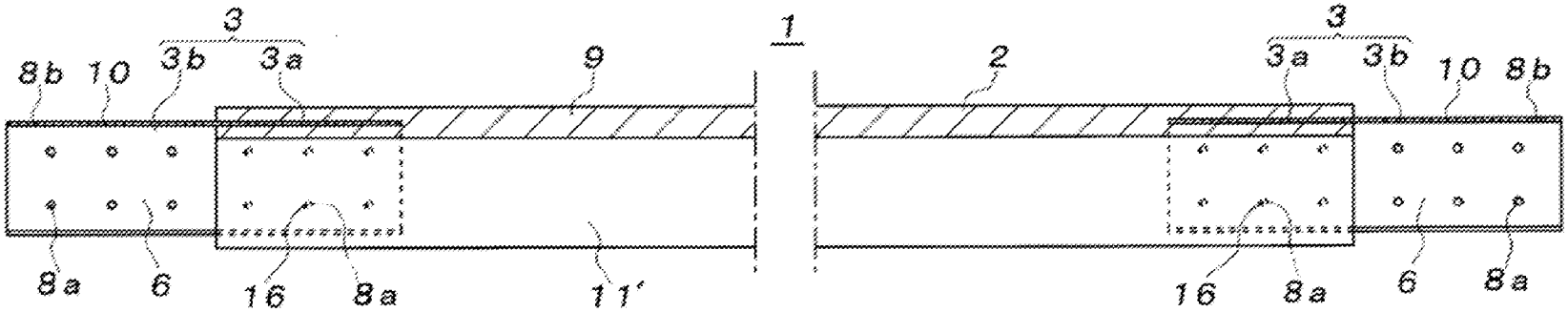
FIG. 14 is a longitudinal sectional view of the concrete girder in FIG. 11.
Figure 15:
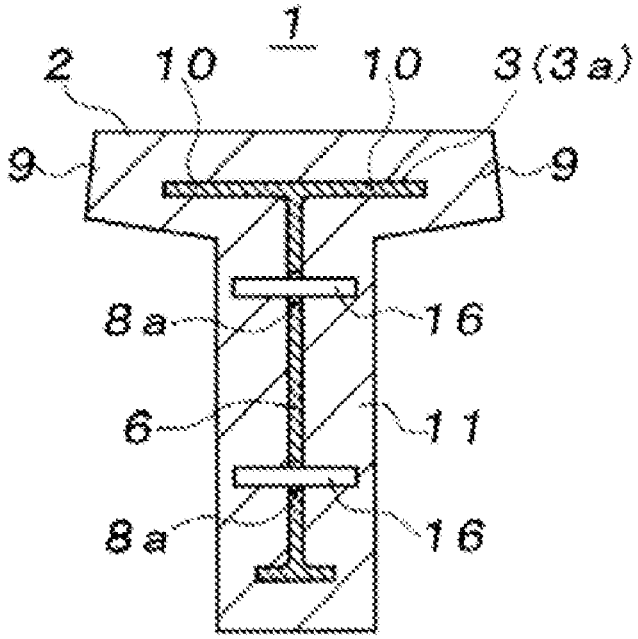
FIG. 15 is a transverse sectional view of the concrete girder in FIG. 11.

Further, as an example, as illustrated in FIG. 5, an inverted U-shaped reinforcing rebar 23 is inserted through the upper and lower flanges 10 of the shaped-steel joint portion 3*a* as straddling the web 6, and then, the shaped-steel joint portion 3*a* may be buried in the end portion of the concrete girder 2 along with the inverted U-shaped reinforcing rebar 23. The U-shaped reinforcing rebar 23 increases connection strength between the shaped-steel joint portion 3*a* and the concrete girder 2 and improves bearing ability of load substantially loaded on the end portion of the concrete girder 2 and the buried portion of the shaped-steel joint portion 3*a*.

Next, in the second embodiment illustrated in FIGS. 6 to 10, an approximate inverted T-shaped concrete girder 2 having small width flanges 9 at both lower sides of a pillar-shaped portion 11 having a relatively large sectional area is utilized for the concrete girder 2, as being similar to the first embodiment. Further, C-shaped steel having flanges 10 protruded to one side respectively from upper and lower ends of the web 6 is utilized for the shaped-steel joint 3 as the rear half part of the C-shaped steel 3 being buried in an end portion of the concrete girder 2 and the front half part thereof being protruded from the end face of the concrete girder 2. Then, both the girder and the joint 2, 3 are structured integrally as described above.

In the second embodiment, the shaped-steel joints 3 at one end and the other end of the concrete girder 2 are respectively formed of two pieces of the C-shaped steel 3. The two pieces of C-shaped steel 3 are buried side by side as being mutually distanced in respective end portions of the concrete girder 2 in a state that the webs 6 are parallel and the flanges 10 are protruded toward outer sides.

Next, in the third embodiment illustrated in FIGS. 11 to 15, a T-shaped concrete girder 2 having flanges 9 at both upper sides of a web 11' is utilized for the concrete girder 2. Further, T-shaped steel having flanges 10 at both sides of the upper end of the web 6 is utilized for the shaped-steel joint 3 as the rear half part of the T-shaped steel 3 being buried in an end portion of the concrete girder 2 and the front half part thereof being protruded from the end face of the concrete girder 2. Then, both the girder and the joint 2, 3 are structured integrally as described above.

In the T-shaped steel, the flanges 10 thereof are buried in the flanges 9 of the T-shaped concrete girder 2 and the web 6 of the T-shaped steel is buried in the web 11' of the T-shaped concrete girder 2.

Not limited to the H-shaped steel, the T-shaped steel and the C-shaped steel illustrated in the above respective embodiments, the present invention includes a case of utilizing shaped-steel having any of various types of sectional shape such as I-shaped steel, L-shaped steel and Z-shaped steel as the shaped-steel joint 3. Then, various types of shaped-steel can be selectively utilized in accordance with the shape of the concrete girder 2.

As the various types of shaped steel, it is also possible to utilize shaped-steel having the various types of shapes by welding a flange plate to a web plate as well as utilizing shaped-steel extrudate due to JIS and the like.

The joint-equipped PC concrete girders 1 described in the first to third embodiments are utilized as being manufactured in a factory and carried to a bridge construction site.

Here, the inverted U-shaped reinforcing rebar 23 described in the first embodiment may be also utilized in the second and third embodiments of the joint-equipped PC concrete girder 1. That is, the inverted U-shaped reinforcing rebar 23 may be buried in the concrete girder 2 as being inserted through the flange 10 of the shaped-steel joint 3*a* as straddling the web 6 even when the C-shaped steel (in the second embodiment) or the T-shaped steel (in the third embodiment) are utilized as the shaped-steel joints 3.

In the following, a rigid connection structure of the bridge pier 4 and the concrete girder 2 by utilizing the joint-equipped PC concrete girder 1 will be described with reference to FIGS. 16A to 25B.

Figure 17:
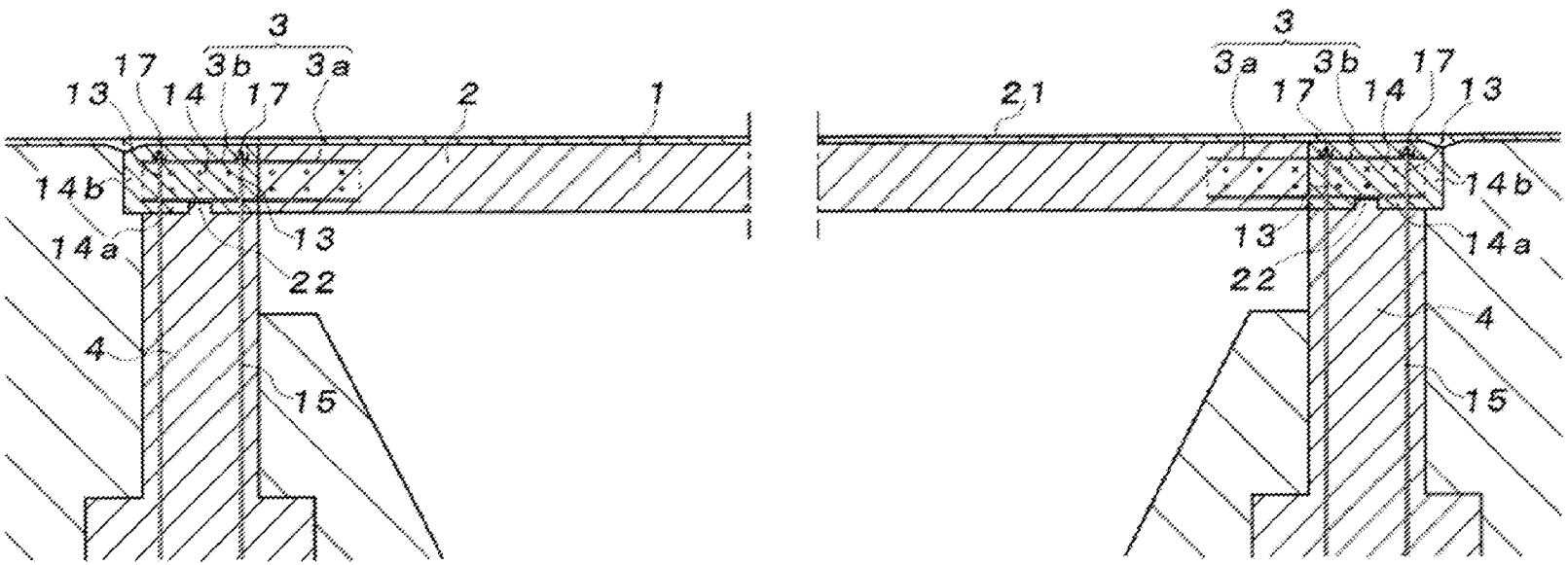
FIG. 17 is a longitudinal sectional view of a single span rigid-frame bridge using the joint-equipped PC concrete girder.
Figure 18:
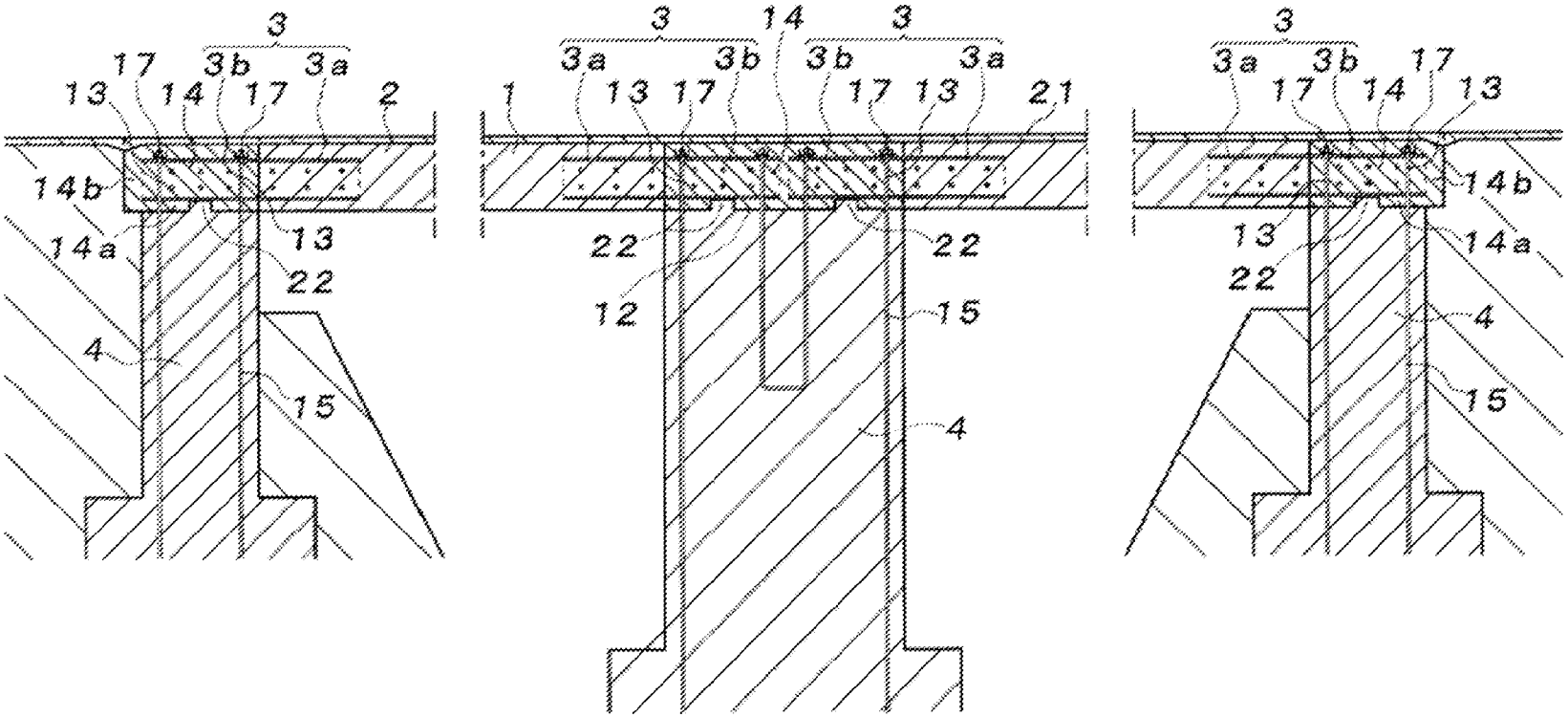
FIG. 18 is a longitudinal sectional view of a multi span rigid-frame bridge using the joint-equipped PC concrete girders.

The below-described rigid connection structure of the joint-equipped PC concrete girder 1 and the bridge pier 4 can be actualized in a single span rigid-frame bridge which is illustrated in FIG. 17 or a multi span rigid-frame bridge which is illustrated in FIG. 18.

Figure 19:
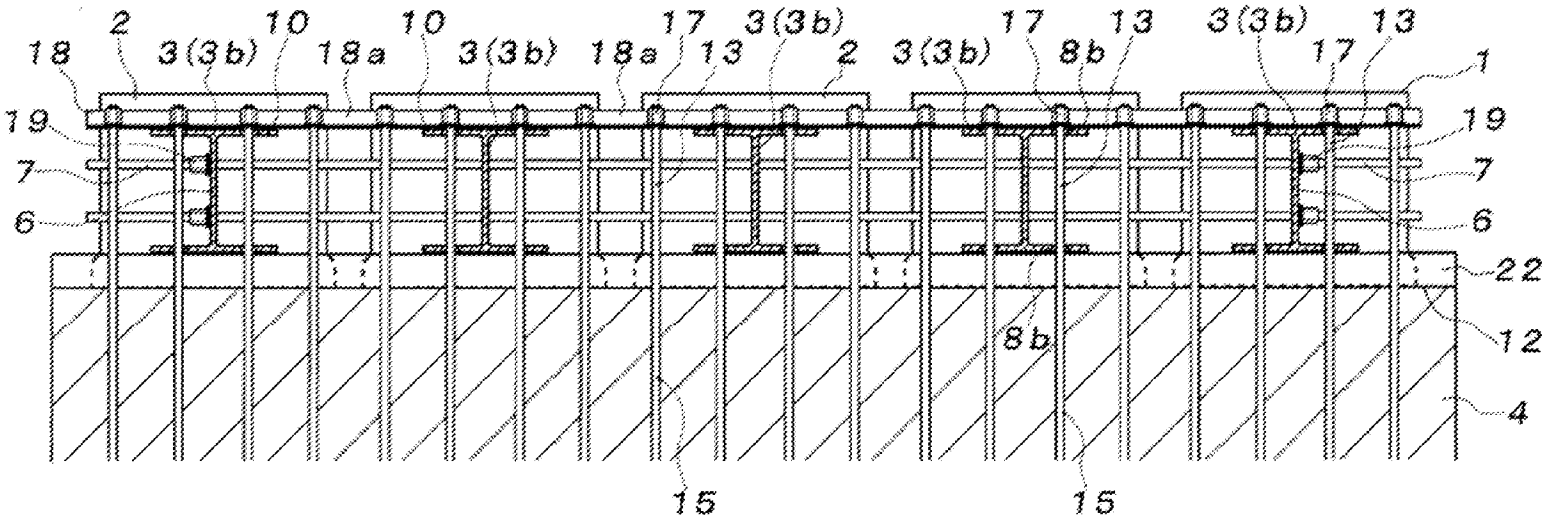
FIG. 19 is a front view of a rigid connection portion of a rigid-frame bridge which is formed by utilizing the joint-equipped PC concrete girders illustrated in FIGS. 1 to 5 in a state before casting the connection concrete.
Figure 20:
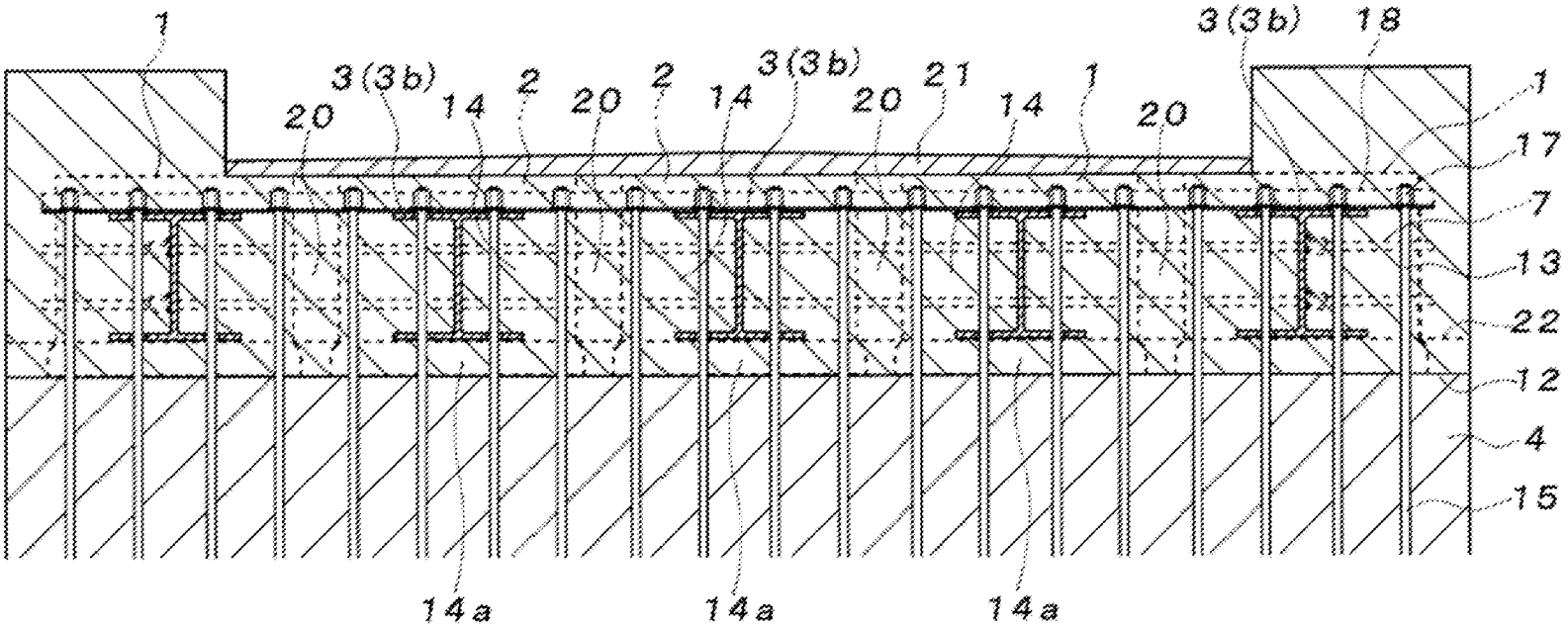
FIG. 20 is vertical sectional view of the rigid connection portion of the rigid-frame bridge which is formed by utilizing the joint-equipped PC concrete girders illustrated in FIGS. 1 to 5 in a state after casting the connection concrete.
Figure 21:
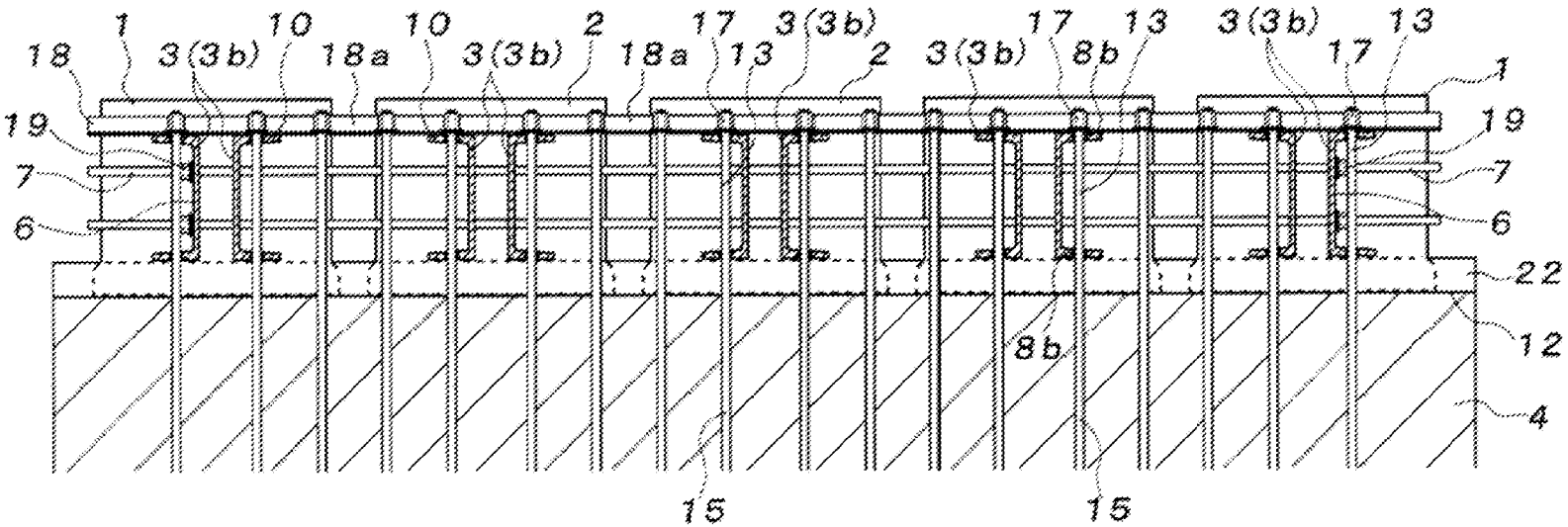
FIG. 21 is vertical sectional view of the rigid connection portion of the rigid-frame bridge which is formed by utilizing the joint-equipped PC concrete girders illustrated in FIGS. 6 to 10 viewing from an end face of the shaped-steel joint in a state before casting the connection concrete.
Figure 22:
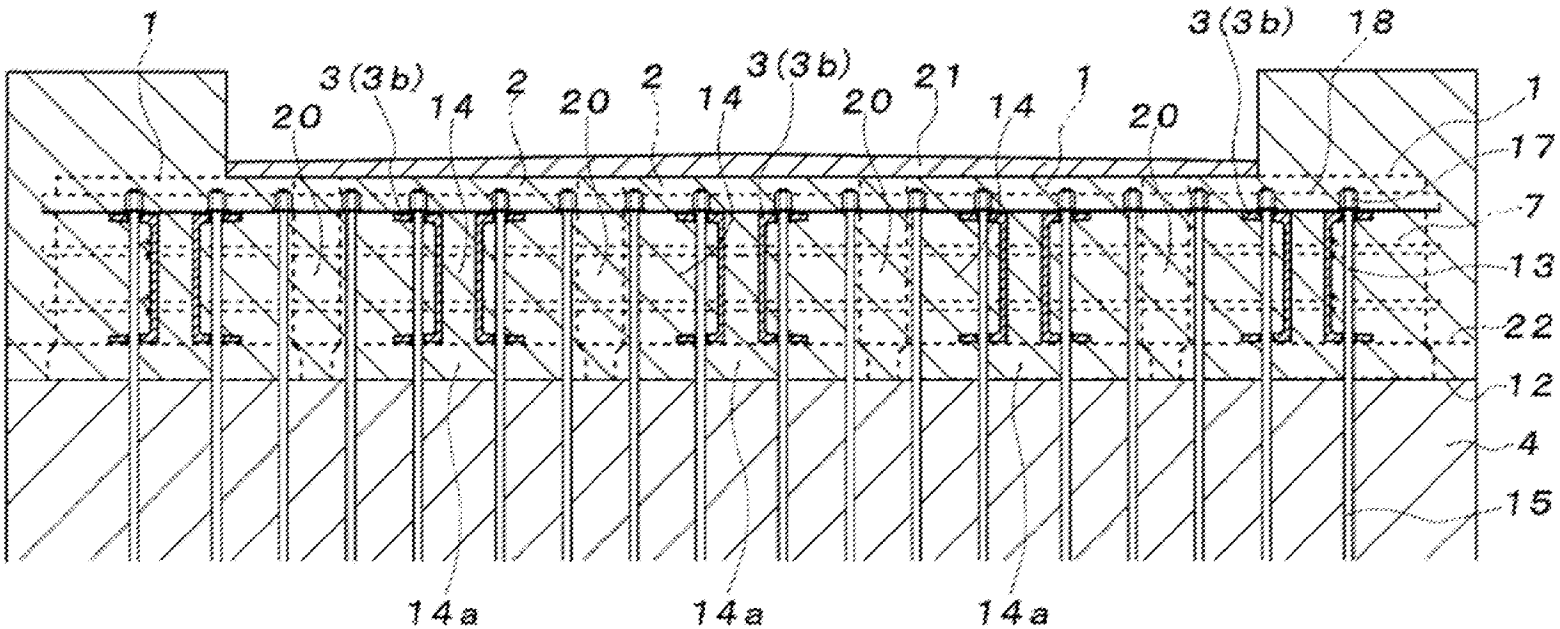
FIG. 22 is vertical sectional view of the rigid connection portion of the rigid-frame bridge which is formed by utilizing the joint-equipped PC concrete girders illustrated in FIGS. 6 to 10 viewing from the end face of the shaped-steel joint in a state after casting the connection concrete.
Figure 23:
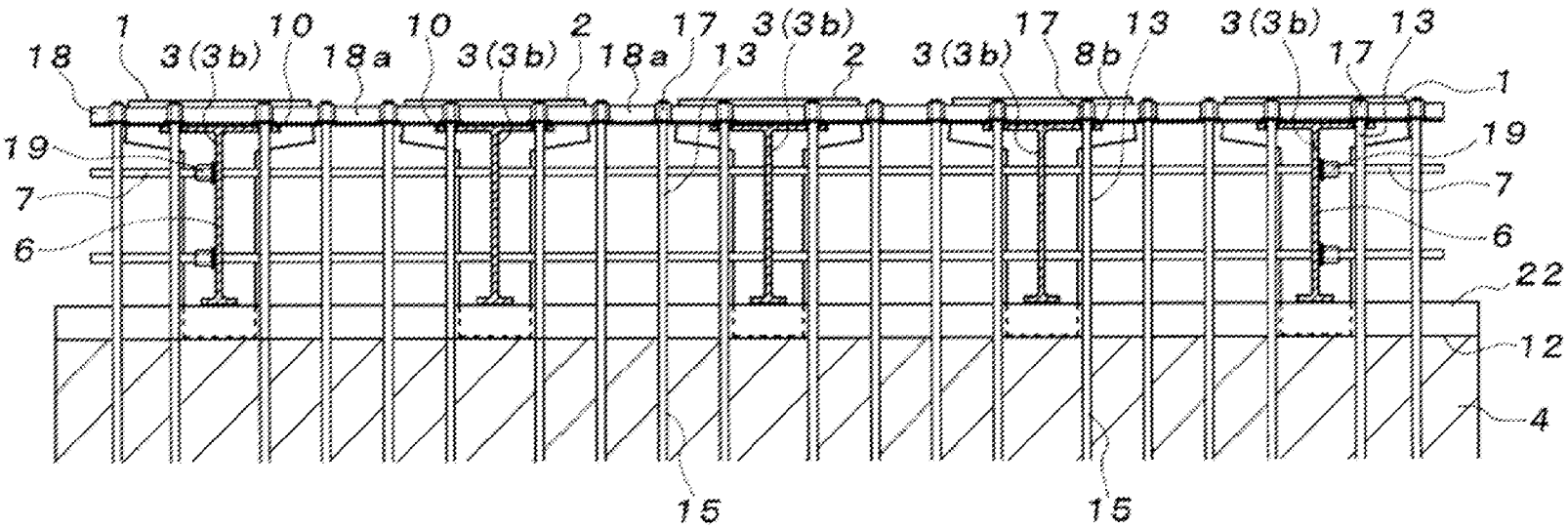
FIG. 23 is vertical sectional view of the rigid connection portion of the rigid-frame bridge which is formed by utilizing the joint-equipped PC concrete girders illustrated in FIGS. 11 to 15 viewing from an end face of the shaped-steel joint in a state before casting the connection concrete.
Figure 24:
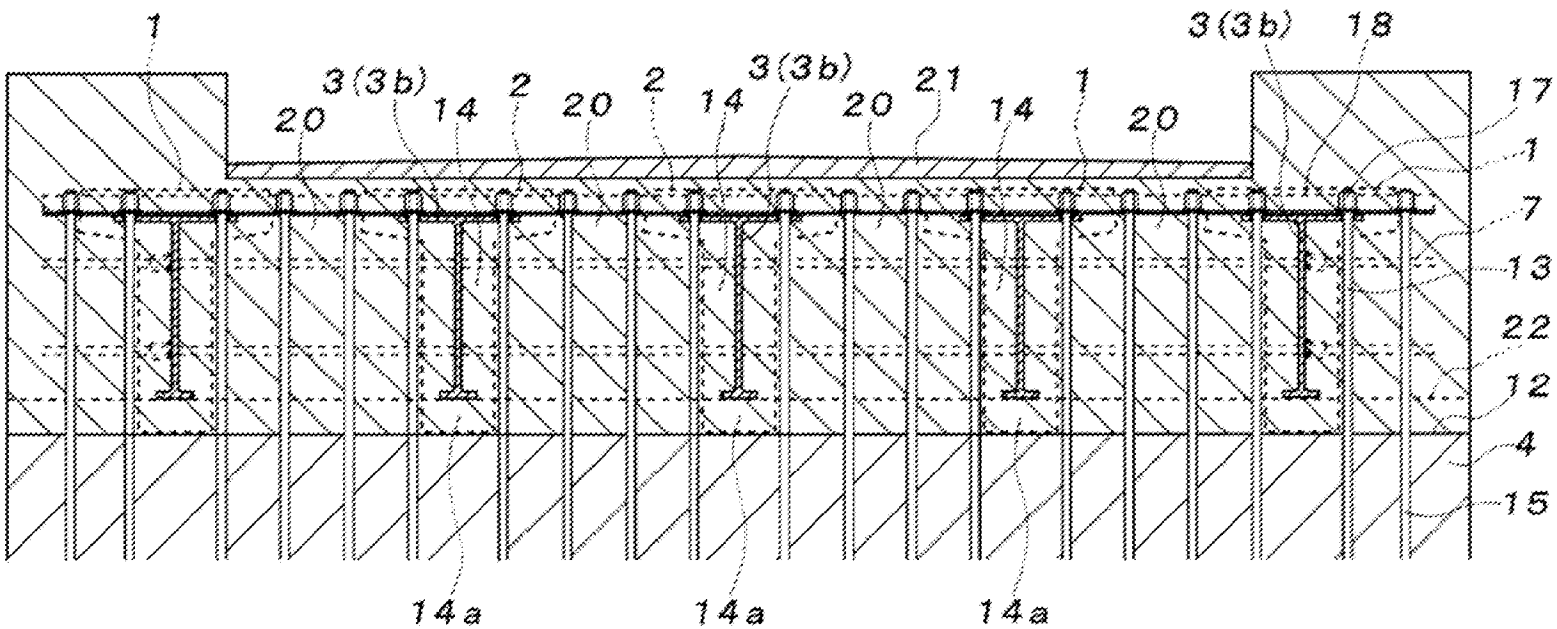
FIG. 24 is vertical sectional view of the rigid connection portion of the rigid-frame bridge which is formed by utilizing the joint-equipped PC concrete girders illustrated in FIGS. 11 to 15 viewing from the end face of the shaped-steel joint in a state after casting the connection concrete.

FIGS. 19 and 20 are transverse sectional views illustrating a rigid connection region of a rigid-frame bridge which is formed by utilizing the joint-equipped PC concrete girders 1 illustrated in FIGS. 1 to 5. FIGS. 21 and 22 are transverse sectional views illustrating a rigid connection region of a rigid-frame bridge which is formed by utilizing the joint-equipped PC concrete girders 1 illustrated in FIGS. 6 to 10. FIGS. 23 and 24 are transverse sectional views illustrating a rigid connection region of a rigid-frame bridge which is formed by utilizing the joint-equipped PC concrete girders 1 illustrated in FIGS. 11 to 15.

FIGS. 19, 21 and 23 are sectional views respectively illustrating a state before connection concrete 14 is casted. FIGS. 20, 22 and 24 are sectional views respectively illustrating a state after the connection concrete 14 is casted.

Figure 16A:
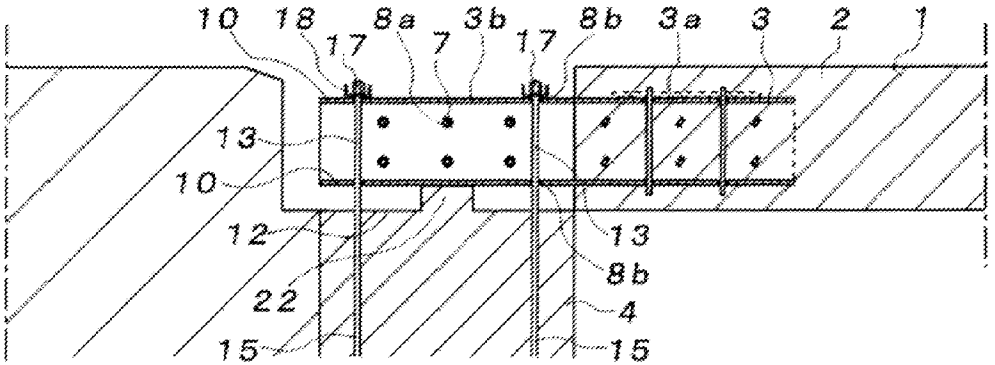
FIG. 16A is a longitudinal sectional view illustrating a rigid connection portion of the concrete pier and the bridge pier in a state before casting connection concrete.
Figure 16B:
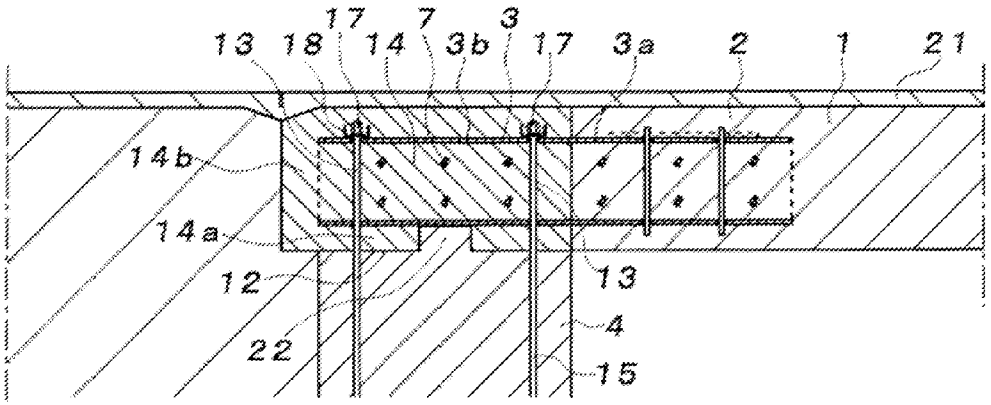
FIG. 16B is a longitudinal sectional view illustrating the same in a state after casting the connection concrete.

FIG. 16A is an enlarged sectional view illustrating the rigid connection portion of the concrete girder 2 and the bridge pier 4 in a state before casting the connection concrete 14. FIG. 16B is an enlarged sectional view illustrating the same in a state after casting the connection concrete 14.

The concrete girders 2 are arranged in parallel in the bridge width direction while supporting the shaped-steel joint portion 3*b* protruded from the concrete girder 2 on a bridge abutment face 12 of the bridge pier 4.

Next, the respective shaped-steel joint portion 3*b* is connected to the connection strip member 13 arising from the bridge abutment face 12. For a specific example, a nut 17 is screwed to the connection strip member 13. Then, the lateral connecting strip member 7 is inserted therethrough and the connection concrete 14 is casted to the upper face of the bridge abutment face 12.

As described above, the rear half part of the shaped-steel joint 3 is buried in the concrete at the end portion of the concrete girder 2 and the front half part of the shaped-steel joint 3 is buried in the connection concrete 14. Accordingly, the concrete girder 2 and the connection concrete 14 are integrally structured via the shaped-steel joint 3.

The connection stripe member 13 being formed of a steel bar such as a rebar, for example, arises from the bridge abutment face 12 having the lower end of the steel bar buried integrally with the concrete bridge pier 4. Alternatively, it is possible to utilize a cable instead of the steel bar.

When the steel bar is utilized for the connection strip member 13, an end portion of a reinforcing rebar 15 buried in the concrete bridge pier 4 is protruded upward from the bridge abutment face 12, thereby forming the steel bar (i.e., the connection strip member 13) with the protruded portion.

The connection strip member 13 is inserted through the through hole 8*b* arranged at the flange 10 of the shaped-steel joint portion 3*b*. The nut 17 is screwed to the protruded end (i.e., a male thread of the protruded end) of the connection strip member 13 protruded from the upper face of the flange 10. Then, the shaped-steel joint portion 3*b* is connected to the bridge pier 4 as fixing the nut 17 on the upper face of the flange 10.

The nut 17 has a stopper function to prevent the shaped-steel joint portion 3*b* from floating. It is also possible to utilize a wedge or a retaining clasp having the stopper function.

In the case that the shaped-steel joint 3 is formed of H-shaped steel, the connection strip member 13 is inserted through the upper and lower flanges 10 of the shaped-steel joint portion 3*b* and the nut 17 is fixed on the upper face of the upper flange 10 as being screwed to the upper portion of the connection strip member 13.

The nut 17 is directly fixed on the upper face of the flange 10 or is fixed on the upper face of the flange 10 via pressure bearing member 18.

The pressure bearing member 18 is arranged as being extended across the shaped-steel joint portions 3*b* in the bridge width direction which is arranged in parallel in the bridge width direction to be arranged on the upper face of the flanges 10 of the respective shaped-steel joint portions 3*b* as bridging thereover.

As an example, one strip of the pressure bearing member 18 is arranged so as to transverse all of the shaped-steel joint portions 3*b* which are arranged in parallel in the bridge width direction. As another example, it is possible that the pressure bearing members 18 are formed to have divided length and each divided pressure bearing member 18 can be arranged on the flanges 10 of two or more adjacent shaped-steel joint portions 3*b* as bridging thereover.

In the case that the pressure bearing member 18 is utilized, a part of a group of the connection strip members 13 is inserted through a portion of the pressure bearing member 18 supported on the flange 10 while being inserted to the through hole 8*b* of the flange 10 of the shaped-steel joint portion 3*b*. Then, the nut 17 is screwed and fixed on the upper face of the pressure bearing member 18.

Further, another part of the group of the connection strip members 13 arises through a space between the adjacent shaped-steel joints 3, that is, arises through a space between the flanges 10. The upper end of the connection strip member 13 is inserted to a portion 18*a* of the pressure bearing member 18 existing as being extended between the shaped-steel joint portions 3*b*, that is, the pressure bearing member portion 18*a* existing as being extended between the flanges 10. Then, the nut 17 is screwed, thereby being fixed on the upper face of the pressure bearing member portion 18*a*.

A shaped-channel such as a C-shaped channel and an L-shaped channel can be utilized for the pressure bearing member 18. The shaped-channel such as a C-shaped channel and an L-shaped channel is suitable for the pressure bearing member 18 as having large bending strength and a large connection effect with the connection concrete 14. The present invention is not intended to exclude a case that a steel flat strip plate is utilized for the pressure bearing member 18 instead of the shaped-channel.

Next, the lateral connecting strip member 7 formed of a steel bar, a steel cable, a cable made of another high-tension fibers and the like is inserted to the through hole 8*a* of each shaped-steel joint portion 3*b* supported on the bridge abutment face 12. The shaped-steel joint portions 3*b* of the concrete girders adjacent in the bridge width direction are mutually connected via the lateral connecting strip member 7. The concrete girders 2 adjacent in the bridge width direction are mutually connected via the connection.

As described above, the lateral connecting strip member 7 is inserted through all of the shaped-steel joint portions 3*b* arranged in parallel in the bridge width direction. Then, each end of the strip member 7 is fixed to the outer side faces of the web 6 as screwing the nuts 19 at the outer side faces of the web 6 of the shaped-steel joint portion 3*b* placed at the outermost end in the bridge width direction.

Before the operation of screwing the nut 17 to the connection strip member 13, the operation of inserting the lateral strip member 7 and screwing the nut 19 can be performed. Alternatively, the operation of inserting the lateral strip member 7 and screwing the nut 19 can be performed after the operation of screwing the nut 17 to the connection strip member 13.

Further, filling concrete 20 is filled along the bridge length direction in the space between the concrete girders 2 of the joint-equipped PC concrete girder 1. Each end of the filling concrete 20 is connected to the connection concrete 14 while being connected to each concrete girder 2, so that a concrete floor slab is formed with the concrete girder 2 and the filling concrete 20.

A roadbed is formed by providing concrete pavement or asphalt pavement 21 on the upper face of the concrete floor slab. Accordingly, the pavement 21 is integrally laminated so as to cover the concrete girder 2, the filling concrete 20 and the shaped-steel joint 3.

The filling concrete 20 may be filled before or after the process of screwing the nut 17 to the connection strip member 13, or before or after the process of inserting the lateral connecting strip member 7.

The shaped-steel joint portion 3*b* of the joint-equipped PC concrete girder 1 is directly supported by the bridge abutment face 12 of the concrete bridge pier 4. Alternatively, a ground member 22 made of concrete or shaped-steel is arranged on the bridge abutment face 12 and the shaped-steel joint portion 3*b* is supported on the ground member 22, that is, the shaped-steel joint portion 3*b* is indirectly supported on the bridge abutment face 12 via the ground member 22 while the ground member 22 is buried in the connection concrete 14.

The connection concrete 14 includes a bottom concrete 14*a* filled in a space formed by the ground member 22 and a side concrete 14*b* covering the side face of the shaped-steel joint 3. Accordingly, the shaped-steel joint portion 3*b*, the lateral connecting strip member 7, the connection strip member 13, the nuts 17, 19, the pressure bearing member 18 and the ground member 22 are buried in the connection concrete 14.

Figure 25A:
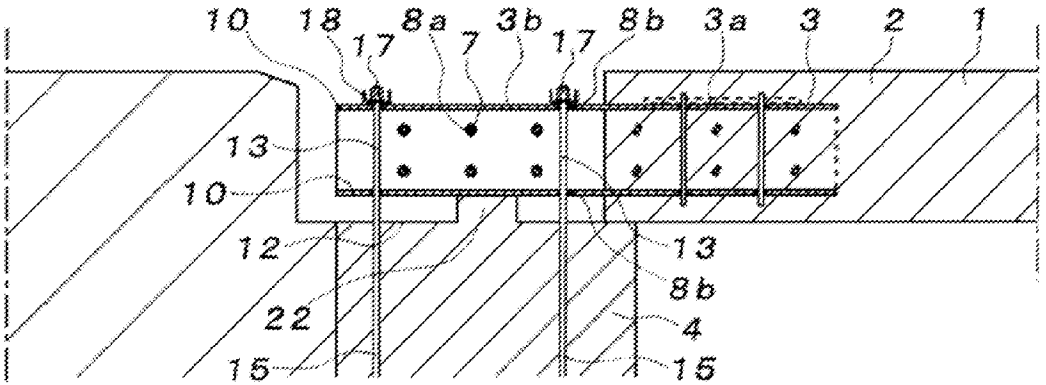
FIG. 25A is a longitudinal sectional view of an example in which the shaped-steel joint portion of the concrete girder and each end of the concrete girder are supported on the bridge abutment face of the bridge pier in a state before casting the connection concrete and FIG. 25B is a longitudinal sectional view of the same in a state after casting the connection concrete.
Figure 25B:
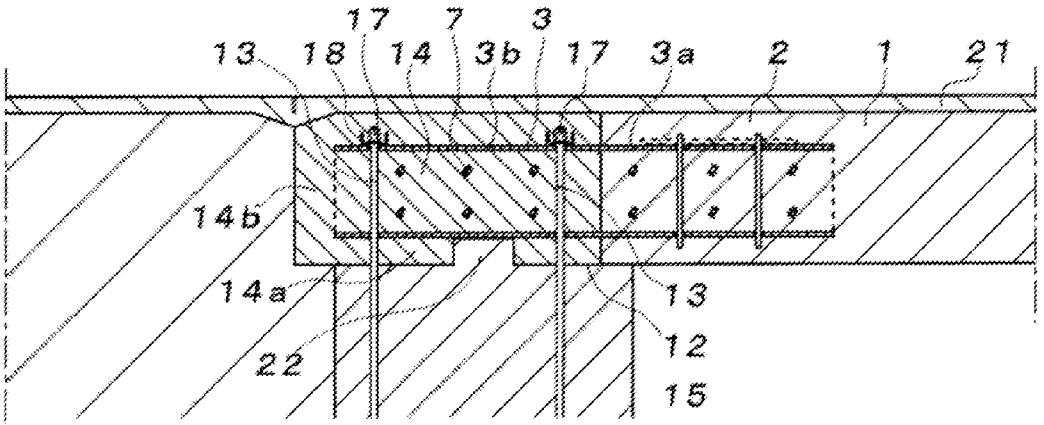

With the joint-equipped PC concrete girder 1, the shaped-steel joint portion 3*b* is supported on the bridge abutment face 12 of the bridge pier 4. Alternatively, as illustrated in FIG. 25, each end of the concrete girder 2 is supported on the bridge abutment face 12 of the bridge pier 4 while the shaped-steel joint portion 3*b* of the concrete girder 1 is supported on the bridge abutment face 12 of the bridge pier 4. Then, the both end faces of the concrete girder 2 are connected to the connection concrete 14.

The respective shaped-steel joint portions 3*b* protruded from the end face of the concrete girder 2 and each end of the concrete girder 2 are received on the bridge abutment face 12 of the bridge pier 4, and then, connection with the connection strip member 13, insertion of the lateral connection strip member 7 and casting of connection concrete 14 on site are performed.

As a matter of course, the example illustrated in FIG. 25 can be actualized in a single span rigid-frame bridge in FIG. 17 and a multi span rigid-frame bridge in FIG. 18.

In the case of the multi span rigid-frame bridge in FIG. 18, ground members 22 are arranged in parallel on the intermediate bridge pier 4, the shaped-steel joint portion 3*b* of the PC concrete girder 1 forming one single span is supported by one ground member 22 to be connected to the connection strip member 13, and the shaped-steel joint portion 3*b* of the PC concrete girder 1 forming the other single span is supported by the other ground member 22 to be connected to the connection strip member 13. The rigid connection structure is formed by burying both of the shaped-steel joint portions 3*b*, both of the lateral connecting strip members 7 and both of the ground members 22 which are respectively opposed on the same bridge pier 4 at the same time in the connection concrete 14.

The invention claimed is:

1. A rigid connection structure of a bridge pier and concrete girder, wherein a joint-equipped PC concrete girder is constituted by a concrete girder having opposing end faces, and steel joint members respectively buried in opposing ends of the concrete girder so as to protrude from the respective opposing end faces of the concrete girder, such that each of the steel joint members has a rear part buried in the concrete girder and a front part protruding therefrom;

wherein each of the front parts of the respective steel joint members that are protruded from the respective end faces of the concrete girder is supported on a bridge abutment face of a bridge pier while being connected to a connection strip member which arises from the bridge abutment face; and wherein each of the front parts of the respective steel joint members and the connection strip member are buried in connection concrete which is additionally casted on the bridge abutment face.

2. The rigid connection structure of a bridge pier and a concrete girder, according to claim 1, wherein each connection strip member is inserted through a flange of each steel joint member and a nut is threaded onto an insertion end of each connection strip member such that the nut is fixed on the respective flange.

3. The rigid connection structure of a bridge pier and a concrete girder, according to claim 1, wherein a lateral connecting strip member is inserted through the front parts of the respective steel joint members;

the joint-equipped PC concrete girder is one of a pair of joint-equipped PC concrete girders having steel joint members with respective front parts that are adjacent to each other; and the adjacent front parts of the steel joint members of the pair of joint-equipped PC concrete girders are mutually connected via the lateral connecting strip member.

4. The rigid connection structure of a bridge pier and a concrete girder, according to claim 1, wherein each concrete girder and the connection concrete are integrally connected via a respective one of the steel joints.

5. The rigid connection structure of a bridge pier and a concrete girder, according to claim 1, wherein the front part of each of the respective steel joint members and one of the ends of the concrete girder are received on the bridge abutment face of the bridge pier.

6. A joint-equipped PC concrete girder for a rigid connection structure of a bridge pier and concrete girder, wherein the joint-equipped PC concrete girder is constituted by a concrete girder having opposing end faces, and steel joint members respectively buried in opposing ends of the concrete girder so as to protrude from the respective opposing end faces of the concrete girder, such that each of the steel joint members has a rear part buried in the concrete girder and a front part protruding therefrom;

wherein each of the front parts of the respective steel joint members that are protruded from the respective end faces of the concrete girder is configured to be supported on a bridge abutment face of a bridge pier while being connected to a connection strip member which arises from the bridge abutment face; and wherein each of the front parts of the respective steel joint members and the connection strip member are configured to be buried in connection concrete which is additionally casted on the bridge abutment face.

7. The joint-equipped PC concrete girder for a rigid connection structure of a bridge pier and a concrete girder, according to claim 6, wherein each connection strip member is inserted through a flange of each steel joint member and a nut is threaded onto an insertion end of each connection strip member such that the nut is fixed on the respective flange.

8. The joint-equipped PC concrete girder for a rigid connection structure of a bridge pier and a concrete girder, according to claim 6, wherein lateral connecting strip members are inserted through the front parts of the respective steel joint members.

9. A bridge including rigid connection structure of a bridge pier and concrete girder, wherein a joint-equipped PC concrete girder is constituted by a concrete girder having opposing end faces, and steel joint members respectively buried in opposing ends of the concrete girder so as to protrude from the respective opposing end faces of the concrete girder, such that each of the steel joint members has a rear part buried in the concrete girder and a front part protruding therefrom;

wherein each of the front parts of the respective steel joint members that are protruded from the respective end faces of the concrete girder is supported on a bridge abutment face of a bridge pier while being connected to a connection strip member which arises from the bridge abutment face; and wherein each of the front parts of the respective steel joint members and the connection strip member are buried in connection concrete which is additionally casted on the bridge abutment face.

10. The bridge including the rigid connection structure of the bridge pier and the concrete girder, according to claim 9, wherein each connection strip member is inserted through a flange of each steel joint member and a nut is threaded onto an insertion end of each connection strip member such that the nut is fixed on the respective flange.

11. The bridge including the rigid connection structure of the bridge pier and the concrete girder, according to claim 9, wherein a lateral connecting strip member is inserted through the front parts of the respective steel joint members;

the joint-equipped PC concrete girder is one of a pair of joint-equipped PC concrete girders having steel joint members with respective front parts that are adjacent to each other; and the adjacent front parts of the steel joint members of the pair of joint-equipped PC concrete girders are mutually connected via the lateral connecting strip member.

12. The bridge including the rigid connection structure of the bridge pier and the concrete girder, according to claim 9, wherein each concrete girder and the connection concrete are integrally connected via a respective one of the steel joints.

13. The bridge including the rigid connection structure of the bridge pier and the concrete girder, according to claim 9, wherein the front part of each of the respective steel joint members and one of the ends of the concrete girder are received on the bridge abutment face of the bridge pier.

14. The bridge including the rigid connection structure of the bridge pier and the concrete girder, according to claim 9, wherein each of the steel joint members has an H-shaped cross section.

15. The bridge including the rigid connection structure of the bridge pier and the concrete girder, according to claim 9, wherein each of the steel joint members is constituted by a pair of pieces respectively having C-shaped cross sections.

16. The bridge including the rigid connection structure of the bridge pier and the concrete girder, according to claim 9, wherein each of the steel joint members has a T-shaped cross section.

17. The joint-equipped PC concrete girder for a rigid connection structure of a bridge pier and a concrete girder, according to claim 6, wherein each of the steel joint members has an H-shaped cross section.

18. The joint-equipped PC concrete girder for a rigid connection structure of a bridge pier and a concrete girder, according to claim 6, wherein each of the steel joint members is constituted by a pair of pieces respectively having C-shaped cross sections.

19. The joint-equipped PC concrete girder for a rigid connection structure of a bridge pier and a concrete girder, according to claim 6, wherein each of the steel joint member has a T-shaped cross section.

20. The rigid connection structure of a bridge pier and a concrete girder, according to claim 1, wherein each of the steel joint members has an H-shaped cross section.

21. The rigid connection structure of a bridge pier and a concrete girder, according to claim 1, wherein each of the steel joint members is constituted by a pair of pieces respectively having C-shaped cross sections.

22. The rigid connection structure of a bridge pier and a concrete girder, according to claim 1, wherein each of the steel joint members has a T-shaped cross section.

* * * * *